US006615553B2

(12) United States Patent
Omundson

(10) Patent No.: US 6,615,553 B2
(45) Date of Patent: Sep. 9, 2003

(54) FLOOR BOARD INSTALLATION DEVICE

(76) Inventor: James Dennis Omundson, 16855 SW. 129$^{th}$ Ave., King City, OR (US) 97244

( * ) Notice: Subject to any disclaimer, the term of this patent is extended or adjusted under 35 U.S.C. 154(b) by 0 days.

(21) Appl. No.: 09/864,565

(22) Filed: May 23, 2001

(65) Prior Publication Data

US 2002/0174607 A1 Nov. 28, 2002

(51) Int. Cl.$^{7}$ ..... G04D 15/02; B66F 1/02; B66F 13/00

(52) U.S. Cl. ..... 52/127.5; 52/749.1; 52/747.1; 52/749.11; 254/17; 254/15; 254/11

(58) Field of Search ..... 52/499.11, 747.1, 52/DIG. 1, 127.1, 127.5, 127.6, 127.9, 749.11; 254/17, 15, 11, 16, 131; 269/904

(56) References Cited

U.S. PATENT DOCUMENTS

| | | | | | |
|---|---|---|---|---|---|
| 59,305 | A | | 10/1866 | Winslow | |
| 96,971 | A | | 12/1869 | Sailer | |
| 104,790 | A | | 6/1870 | Taff | |
| 371,169 | A | | 10/1887 | Brown | |
| 396,104 | A | * | 1/1889 | morrill | 254/15 |
| 527,474 | A | | 10/1894 | Bates | |
| 822,126 | A | | 5/1906 | Hopkins | |
| 863,394 | A | | 8/1907 | Hopkins | |
| 940,695 | A | * | 11/1909 | junker | 254/17 |
| 1,000,859 | A | | 8/1911 | Vaughan | |
| 1,048,519 | A | | 12/1912 | Fuhs | |
| 1,266,253 | A | | 5/1918 | Hakanson | |
| 1,299,822 | A | | 4/1919 | Chute | |
| 1,911,705 | A | * | 5/1933 | mcmullan | 254/17 |
| 2,948,507 | A | * | 8/1960 | gould | 254/15 |
| 4,821,784 | A | | 4/1989 | Cone | |
| 5,139,231 | A | * | 8/1992 | temple | 254/15 |
| 5,248,127 | A | * | 9/1993 | young | 254/15 |
| 5,269,494 | A | | 12/1993 | Pittman et al. | |
| 5,478,050 | A | * | 12/1995 | ott | 254/17 |
| 5,826,858 | A | | 10/1998 | Gordon | |
| 5,845,548 | A | | 12/1998 | Nelson | |
| 5,964,450 | A | | 10/1999 | Pasto | |

FOREIGN PATENT DOCUMENTS

| | | | | |
|---|---|---|---|---|
| DE | 3631351 | * | 2/1988 | 254/17 |

* cited by examiner

*Primary Examiner*—Lanna Mai
*Assistant Examiner*—Phi Dieu Tran A
(74) *Attorney, Agent, or Firm*—Ingrid McTaggart

(57) ABSTRACT

A floor board installation device comprises a cross bar, a wedge and two pins extending outwardly from the top and bottom sides of, and through, the cross bar. The wedge comprises a top curved edge and a bottom edge including a groove therein. The pins typically are spaced from one another a distance slightly larger than the width of a joist. In use, the cross bar is placed on top of two adjoining joists so that the pins are positioned on either side of a single joist. The other end of the bar merely rests on top of the adjacent joist. A force is then applied to a side edge of the wedge in a direction parallel to the length of the sub floor boards. Due to the rounded shape of the top curved edge and the flat surface of the wedge that contacts the floor board, the wedge will rotate within the cross bar so that the edge of the wedge is flush against the sub floor board and so that the curved surface of the wedge will contact the cross bar at only one point. Accordingly, the force applied to slide the wedge along the cross bar will tend to push the floor boards together.

13 Claims, 3 Drawing Sheets

Fig. 1
*(PRIOR ART)*
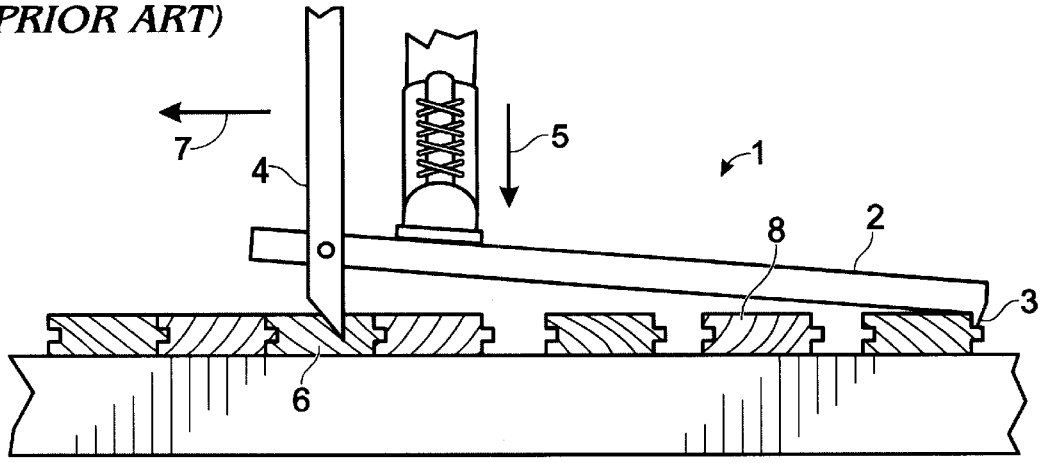
Fig. 2
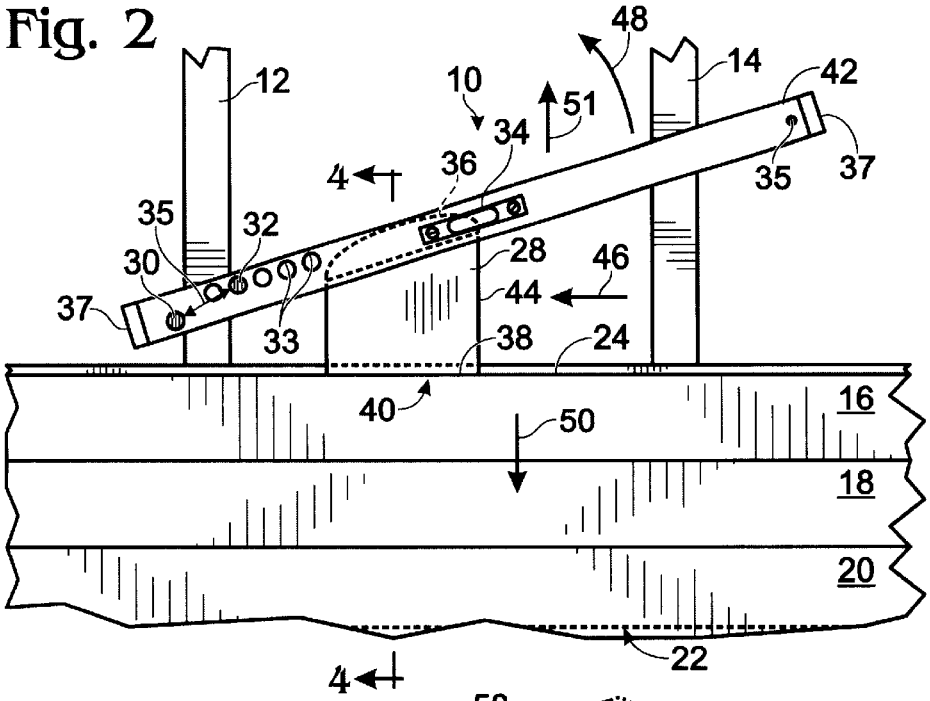
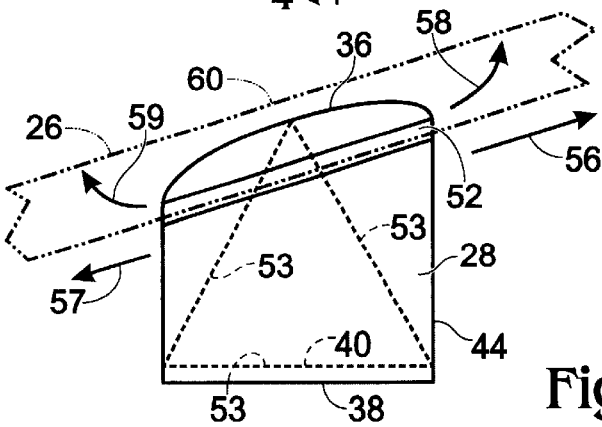
Fig. 3

FLOOR BOARD INSTALLATION DEVICE

TECHNICAL FIELD

The present invention relates to a floor board installation device, and more particularly, to a sub-floor plank installation device which allows a carpenter to position tongue and groove planks tightly together so that the planks may be secured to an underlying support without gaps between the planks.

BACKGROUND OF THE INVENTION

While installing a sub-floor, carpenters must place the planks or boards tightly against one another so that there are no gaps between the boards. Placing the boards tightly together is sometimes called "pushing" or "pulling" the floor boards together. Pulling of the planks together before securing the planks to the sub-floor supports, such as a series of joists or stringers, provides a strong sub-floor for placement of the finished floor thereon. Pulling of the sub-floor boards tightly together also reduces any noise produced by the finished floor.

A conventional floor pulling device comprises a lever arm having an end that is stomped on to push a sharp point into the top surface of a previously installed sub-floor board. Another board is then placed next to the previously installed sub-floor plank and is captured by an arm of the pulling device. The carpenter then pushes the lever arm away from the boards being pulled, which pulls the loose board or boards toward the previously installed sub-floor board.

In particular, referring to FIG. 1, a prior art deck pulling device 1 is shown in use. The lower arm 2 of the device includes a downwardly extending lip 3 that is placed around the edge of a loose floor plank. The movable arm 4 of the device is held upwardly by a carpenter as the carpenter stomps with his or her entire weight on the lower portion 2 of the device in a direction 5. This stomping action forces a sharp tip of the movable arm into a floor plank 6 nailed to the floor joists. The carpenter then forces movable arm 4 in a direction 7, which pulls lower arm 2 in the same direction. This acts to pull the loose floor planks 8 in direction 7. (The spacing between several ones of loose floor planks 8 is exaggerated for purposes of illustration.) The sharp point of the movable arm typically must be secured to a somewhat centrally located plank that has been fastened (not the last plank secured to a joist) or the device will merely act to rip the last secured board from the joist. The prior art device typically may be used to pull up approximately forty-eight inches of boards, as defined by the length of lower arm 2, wherein several of the boards include the two or three previously secured boards. Accordingly, the device must be used to pull boards every forty inches or so along the length of the floor. Moreover, the device typically must be placed directly over a joist or the stomping action of the carpenter will merely force the boards to bend downwardly such that the sharp point of the movable arm does not become embedded in the secured plank. In other words, stomping on the device between joists will merely cause the floor planks to deflect downwardly so that the sharp point of the movable arm will not cut into the plank. Additionally, the prior art device must be positioned near the joists so that the planks will be pulled tightly at the point of nailing to the joist. The device, therefore, must be used to pull the planks at every joist position along the floor being installed, which typically is every four feet or less.

This prior art device has several disadvantages. First, the device is not free standing and requires a first carpenter to hold the movable lever arm upright while the sub-floor board is nailed down by a second carpenter. Accordingly, this device requires a two-man operation. Second, the device is secured in place by stomping the sharp point into the top surface of the sub-floor. This may damage the sub-floor and may render the sub-floor unsuitable for placement of a finished floor thereon. Moreover, this stomping action, which typically requires the carpenter to stomp the lower arm downwardly from a height of sixteen inches or more above the floor, every few feet along the floor, severely strains the carpenter's foot. Many carpenters have chronic and painful foot conditions due to this required stomping action, repeated through out every working day for an entire career. Third, the downwardly extending lip of the device grasps the loose floor board about its tongue or groove edge which tends to mar the edge of the board. This may reduce the possibility that a good fit is achieved between adjacent tongue and groove planks. Fourth, only a few planks can be pulled at one time, i.e., the number of planks pulled is limited by the length of the lower arm of the device. Typically, approximately forty inches of planks can be pulled at one time. Additionally, the device must be used at intervals of approximately forty inches along each joist or stringer of the floor being installed. In a floor for a standard house, this may require approximately 80 pulls of the sub-floor planks.

To install a plywood sub floor (or a "two-for-one" floor, such as 1⅛ inch plywood sheet, which functions as both the sub floor and the under layment for carpet or vinyl), the decking puller described above cannot be used. In particular, the downwardly extending lip of the prior art decking puller may damage the delicate tongue or groove edge of the plywood sheets. To avoid damage to the expensive plywood sheets, a board having a mating tongue or groove edge is positioned next to the plywood. Because the tongue side of the plywood typically is more delicate than the groove side, the groove side of the plywood typically is subjected to a pushing force. One or two carpenters typically stand on the board positioned next to the groove side of the sheet, and each carpenter hits the board with a sledge hammer. Two carpenters may be required to prevent the plywood sheet from scooting in a side direction or in order to provide enough force to push the plywood sheet against an adjacent plywood sheet. The force applied by the sledge hammers will tend to push the plywood sheet up against the adjacent secured plywood sheet so that the tongue and groove edges of the sheets engage one another. However, because of the glue placed within the mating tongue and groove area of the adjacent boards, the loose board will tend to bounce off the fastened board. A third carpenter typically attempts to fasten the moving plywood sheet to the stringers just as the loose board is at the peak of its bounce, i.e., when the plywood sheets have their tongue and groove edges correctly and tightly mated together. This bouncing action is also enhanced due to presence of wet glue that typically is positioned between the plywood sheets and the stringers. Accordingly, there currently is no satisfactory method of pulling multiple plywood sheets together for fastening of the sheets to the sub floor joists. Moreover, the method of pushing even a single plywood sheet against a secured plywood sheet has many drawbacks.

Another pushing device, typically used on furniture or boat hulls, comprises a base having a wedge contacting surface, wherein the base is secured to a support. The base may be nailed or bolted to a hull support, or may be secured by pins that are forced downwardly into the top surface of the support. The small end of a wedge is then positioned between the support and the wedge contacting surface of the base. A force is applied to the wedge to force it further between the base and the boards. The tapered shape of the wedge will force either the base or the boards to move. Because the base is securely fastened to the support, the wedge will tend to force the hull boards away from the base, thereby forcing adjacent boards together. Once the boards are pushed together and then nailed in place, the nails or bolts of the base are removed from the support. The base is moved along the support to a new location and the process is repeated.

There are several disadvantages to this conventional boat construction device. First, the base and the wedge are not connected together so the wedge piece may be dropped through the unfinished hull. This can be inconvenient in that the carpenter must retrieve the wedge from the ground. In a worst case scenario, the heavy metal wedge may fall on and injure a co-worker working below the hull installation site. Second, the base is secured to the support with nails or bolts. These nails and bolts can damage the support and are time consuming to install and remove, especially when the base is secured to a support sequentially at two or three foot intervals during the installation process. Third, the base typically has a single orientation in which the base may be secured to a joist. Accordingly, the boards can be tightened in only one direction. This inflexibility of this prior art device requires a carpenter to start at one end of a hull and to lay the planks in a single direction. For these reasons, Applicant believes this boat construction device has not been utilized for floor installations.

Accordingly, there is a need for a sub floor board installation device that reduces the risk of loosing or dropping the heavy wedge, may be quickly secured to and released from a joist, facilitates flooring in either of two directions, allows one-man operation, does not damage the floor boards, does not contribute to chronic injury of the carpenter, and allows a floor to be installed with fewer individual pulling operations.

SUMMARY OF THE INVENTION

The present invention includes a cross bar, a wedge and two pins extending outwardly from the top and bottom sides of, and through, the cross bar. The cross bar may further include a handle for ease of positioning the cross bar on a set of joists. The wedge comprises a top curved edge and a bottom edge including a groove therein. The pins typically are spaced from one another in the base a distance slightly larger than the width of a joist. The wedge is secured to the cross bar so that the device comprises an integral unit.

In use, the cross bar is placed on top of two adjoining joists so that the pins are positioned on either side of a single joist. The other end of the cross bar merely rests on top of the adjacent joist. A groove in a board contacting surface of the wedge is positioned on a tongue portion of a board. (An adapter may be secured to the edge of the wedge so that the wedge may be placed against the groove side of a plank). A force is then applied to a side edge of the wedge by a sledge hammer in a direction parallel to the length of the sub floor boards. Due to the rounded shape of the top curved edge and the flat board contacting surface of the wedge, the wedge will rotate within the cross bar so that the edge of the wedge is flush against the sub floor board and so that the curved surface of the wedge will contact the cross bar at only one point. The force on the side edge of the wedge will tend to rotate the far end of the cross bar in a direction away from the floor boards, wherein movement of the cross bar is limited by the pins positioned on either side of the joist. The pins will retain the cross bar in this fully-rotated, limiting position. Accordingly, any additional force applied to the wedge will tend to push the floor boards together, i.e., away from the wedge. If a distant board is nailed to the joists, then the force on the wedge will tend to compress the loose boards against the stationary board. In this manner, the sub floor boards can be pushed together, sometimes called "pulling" of the boards together, so that each of the boards can be nailed to the joists. When several boards are nailed in place, the wedge (or several wedges positioned in a row) is merely lifted up and moved further down the joists for positioning of additional boards between the wedge device and the board which was most recently nailed to the joists.

Accordingly, an object of the present invention is to provide a sub floor board installation device that may be quickly secured to and released from a support member.

Still a further object of the present invention is to provide a sub floor board installation device that facilitates flooring in either of two directions.

Yet another object of the present invention is to provide a sub floor board installation device that allows one-man operation.

A further object of the present invention is to provide a sub floor board installation device that does not damage the floor boards.

Still another object of the present invention is to provide a sub floor board installation device that does not contribute to chronic injury of the carpenter.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

BRIEF DESCRIPTION OF THE DRAWINGS

FIG. 1 is a view of a prior art sub floor plank installation device in use.

FIG. 2 is a top view of the floor board installation device in use;

FIG. 3 is a top view of the wedge of the floor board installation device;

DETAILED DESCRIPTION

Figure 4:
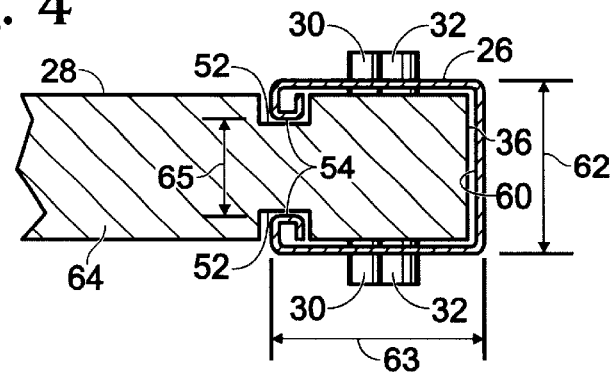
FIG. 4 is a side cross sectional view of the wedge positioned within the cross bar of the floor board installation device.

This invention pertains to a floor board installation device. In particular, the invention pertains to a device that pushes planks together so that the tightly positioned sub floor planks, also called decking, can be nailed in place to underlying joists. Nailing of the planks to the joists when the planks are pushed together results in a strong and silent sub floor.

FIG. 2 is a top view of the floor board installation device 10 positioned on cross beams, or joists, 12 and 14, and adjacent several sub floor boards 16, 18 and 20. Floor boards 16, 18 and 20 typically are tongue-and-groove boards, each having a recessed groove 22 and an extending tongue 24. However, the sub floor boards may comprise flat edged floor boards, or large sheets of manufactured floor boards such as tongue and groove particle board, plywood or oriented stand board (OSB). In other words, the device of the present invention may be used to pull any type of flooring material together on the sub floor joists.

Device 10 includes a cross bar 26, a wedge 28 and two pins 30 and 32 extending outwardly from the top and bottom sides of, and through, cross bar 26. The pins typically extend outwardly on both sides of the cross bar so that the cross bar can be placed on floor joists with either side of the cross bar facing upwardly. In this manner, a carpenter may use the device to lay sub floor boards in either of two directions, i.e., in a north or a south direction. Moreover, the device can be positioned facing either of two directions so that the device may be used by either a left or a right handed operator.

The base further includes a series of holes 33 so that pin 32 may be positioned at a variety of distances 35 from pin 30 so that the device may be secured to a variety of joists. Pins 30 and 32 typically are spaced from one another a distance 35 slightly larger than the width of joists 12 and 14. Accordingly, the pins of the present invention may be positioned; two inches apart so as to be secured to a joist having a thickness of 1½ inches; four inches apart so as to be secured to a joist having a thickness of 3½ inches; six inches apart so as to be secured to a joist having a thickness of 5½ inches; and so forth. Those skilled in the art will understand that as the clearance between the pins and the joist is decreased, the amount of rotational movement by the cross bar with respect to the joist will be decreased. Furthermore, the variety of positions of the pins allows a carpenter to adapt placement of the pins so as to compensate for differing kinds of wood, i.e., soft and hard woods, and woods having a variety of water content.

Bar 26 typically includes a handle 34 for ease of positioning the cross bar. The cross bar may further include a handle (not shown) on the other side of the bar that is used to grip the device when the device is turned over and used to lay sub floor boards in an opposite direction than shown.

Still referring to FIG. 2, wedge 28 comprises a top curved edge 36, also called an arcuate surface, and a generally flat bottom edge 38 including a groove 40 therein. Cross bar 26 may comprise a pin 35 that extends through the hollow channel of the cross bar so that pins 32 and 35 retain the wedge within the cross bar. The cross bar may further comprise end caps 37 that add a decorative element to the device and may also function to add a cushioning effect to the somewhat sharp or exposed ends of the cross bar.

In use, cross bar 26 is placed on top of two adjoining joists 12 and 14 so that pins 30 and 32 are positioned on either side of a single joist 12. Opposite end 42 of the cross bar merely rests on top of joist 14. Accordingly, device 10 sits in a plane just above the joists and cannot tip over, as do some prior art devices. Due to the length of cross bar 26, device 10 is self supporting and does not require a two-man operation. In other words, one person may set the device in place, and then apply a force to the wedge, without the requirement that a separate person hold the device in place. The device of the present invention, therefore, reduces by fifty percent the man power operation costs of installing a floor.

Figure 9:
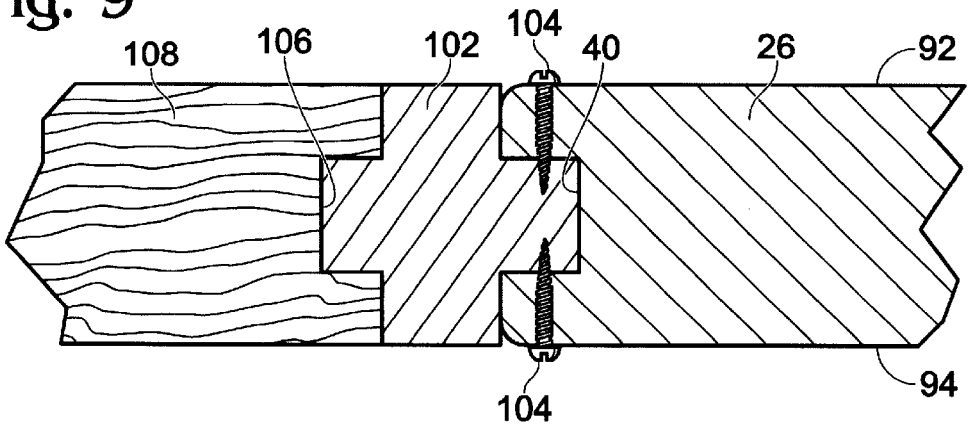
FIG. 9 is a side cross sectional view of the wedge having an adapter secured thereto.

Referring still to use of the device, groove 40 of wedge 28 is positioned on tongue 24 of board 16. (An adapter may be secured to edge 38 of wedge 28 so that the wedge may be placed against the groove side of a floor board, as shown in FIG. 9). The shape of groove 40 typically matches the shape of the floor board so that the wedge does not mar or deform the sub floor board. In this manner, the tongue or groove of the floor board is not damaged and adjacent boards may be tightly fit against one another.

After placement of the wedge against a plank, a force is applied to a side edge 44 of wedge 28 in a direction 46, such as by a sledge hammer. Due to the rounded shape of top curved edge 36 and flat surface 38 that contacts plank 16, wedge 28 will rotate within bar 26 so that edge 38 is flush against plank 16 and so that curved surface 36 of the wedge will contact bar 26 at only one point. The force on side edge 44 will tend to rotate end 42 of base 26 in a direction 48, which is limited by pins 30 and 32 positioned on either side of joist 12. The pins will retain bar 26 in this fully-rotated, limiting position. Accordingly, any additional force applied to wedge 28 in a direction 46 will tend to push planks 16, 18 and 20 in a direction 50, thereby pushing the boards together. If a distant board, board 20 for example, is nailed to the joists, then the force on the wedge will tend to compress boards 16 and 18 against stationary board 20. In this manner, sub floor boards can be pushed together, sometimes called "pulling" boards together, so that each of the boards can be nailed to the joists. Once the force on the wedge is removed, the friction between the wedge and the floor boards will retain the boards in this tight, pulled orientation. Accordingly, a second carpenter is not required to hold the wedge in place while the boards are nailed to the joists.

Applicant has tested the present invention and has found that as many as forty boards, having a combined width of approximately twenty five feet can be successfully pulled together with the device of the present invention with one pulling action, i.e., without moving the wedge device. In contrast, prior art board pulling devices typically are used to pull approximately three feet of boards together. Accordingly, the device of the present invention allows the tool to be secured to a joist at only a few locations during the pulling process so that the tool need not be moved and repositioned as many times as is required of prior art devices. The present invention has also been found by Applicant to successfully pull together several sheets of plywood at a time wherein a polyurethane glue, such as Vulkem brand or 3M 5200 brand glue, is placed between the joints of the several plywood sheets.

Even in this highly frictional environment, the installation tool of the present invention successfully pulled the plywood sheets together for nailing to the underlying floor joists.

After boards 16, 18 and 20 have been nailed in place, device 10 is merely lifted up from the joists and moved down joists 12 and 14 in a direction 51 for positioning of additional boards between the wedge device and board 16. Because pins 30 and 32 merely extend downwardly on either side of floor joist 12, the carpenter is not required to loosen bolts or pins to remove the device. The carpenter simply pulls the device upwardly to remove it from the joists. Moreover, because wedge 28 is retained within cross bar 26, the carpenter need only pull up on handle 34 to remove all components of the device from their position adjacent floor board 16. In other words, there are no loose parts that can fall from the device. Furthermore, due to the length of cross bar 26, which typically is longer than the spacing between sub floor joists such as joists 12 and 14, device 10 is not easily dropped between the joists.

FIG. 3 is a top view of wedge 28. The wedge includes a recessed groove 52 adjacent curved edge 36. Recessed grooves 52 typically are positioned on both an upper surface (as shown) and on a lower surface (not shown) of the device which allows the wedge to be slidingly moved within bar 26. Top curved surface 36 and flat surface 38 ensure a three point contact so that surface 38 is always positioned flat against a board 16. By "three point contact" Applicant means that wedge 28 will contact the floor board at two points, i.e., along a line, and will contact the inner surface of cross bar 26 at a single point. In other words, the curved surface of the wedge ensures a flush, flat contact between the board contact surface of the wedge and the board being pulled. This ensures that the full force applied to side edge 44 of the wedge by a sledge hammer or the like is evenly applied to the floor board being installed. In other words, this three point contact results in a triangulation, shown by dash lines 53, which will be understood by those skilled in the art as providing a strong force against the floor boards so as to move them in direction 50.

Wedge 28 typically is manufactured of a sturdy material that can withstand blows from a sledge hammer. In particular, wedge 28 may be manufactured of ultra high molecular weight (UHMW) plastic, sometimes referred to as white UHMW plastic, wood, metal, or any other such sturdy material.

Wedge 28 of the present invention slides within bar 26 (shown in dash lines) in directions 56 and 57 and also rocks, or rotates, within base 26 in directions 58 and 59, with respect to a rear surface 60 of cross bar 26. In order to allow rocking of the wedge, i.e., rotation of the device in directions 58 and 59 with respect to the cross bar, groove 52 in the wedge should have a width greater than the width of rolled edges 54 of the cross bar (shown in FIG. 3). Due to the rocking motion of the wedge with respect to the cross bar, surface 38 of wedge 28 maintains flush contact with the edge of board 16, regardless of the angle made by the cross bar with respect to the support joists. Accordingly, a force can be applied to the wedge at a ninety degree angle with respect to movement of the sub floor boards, i.e., in direction 46 (FIG. 1), so that the sub floor boards are not damaged along their delicate tongue or groove edges. In other words, hitting delicate tongue 24 of the sub floor boards directly with a sledge hammer in a direction 50 is not required by the present invention.

FIG. 4. is a side cross sectional view, taken along line 4—4 of FIG. 2, showing wedge 28 positioned within bar 26. The cross section is taken along the vertical line of contact of curved surface 36 with inner surface 60 of the cross bar, i.e., at the tangential point of contact of the wedge with the cross bar. (This tangential point of contact is shown as the upper point of triangle 53 of FIG. 3). Recesses 52 of the wedge are captured by rolled edges 54 of cross bar 26, also called a base. Cross bar 26 typically is manufactured of a strong, rigid material that will not deform under pressure, such as a metal or a rigid plastic. In one embodiment, cross bar 26 is manufactured of steel, such as in the form of a uni-strut as well known in the art, so that rolled edges 54 will not deform when wedge 28 is struck with a large striking force. As stated above, the width of recesses 52 of the wedge typically are larger than the thickness of rolled edges 54 so that wedge can rotate somewhat within the cross bar and align itself with edge 38 (FIG. 2) of the wedge positioned flush against a floor board 16. Cross bar 26 typically has a width 62 of approximately 2.0 inches, a depth 63 of approximately 3.0 inches, and defines an opening 64 between rolled edges 54 having a width 65 of approximately 1.2 inches.

Figure 5:
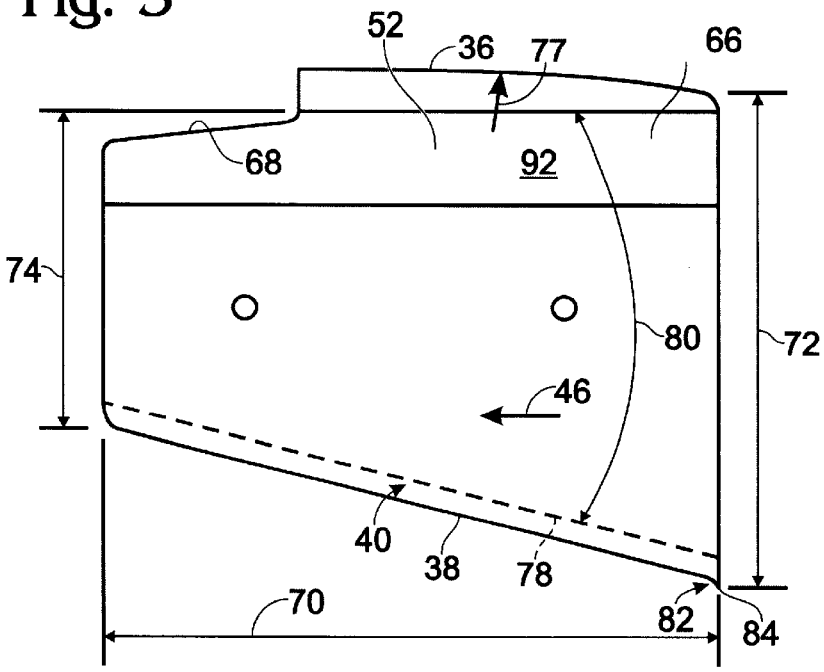
FIG. 5 is a top view of another embodiment of the wedge of the floor board installation device.

FIG. 5 is a top view of another embodiment of the wedge of the floor board installation device. Wedge 66 comprises top curved surface 36, bottom edge 38 and groove 52 therein. In this embodiment, top curved edge 36 includes a cutout area 68 so that the wedge may be moved in a direction 57 (see FIG. 2) within cross bar 26 without contacting with pin 32 (FIG. 2) that extends through cross bar 26. Accordingly, movement of wedge 66 in direction 57 within cross bar 26 is limited by pin 30 (FIG. 2). This allows the wedge to be force closer to the end of the cross bar which may lessen the amount of cross bar adjustment on the joists that is required. Moreover, this may allow the installation device to be used to secure boards up to the very edge of the sub floor support system.

In the particular embodiment shown, wedge 66 has a length 70 of 13.5 inches, a height 72 of 10 inches, and defines a distance 74 from curved surface 36 to bottom edge 38 of approximately 6.5 inches. Cutout region 68 has a length 76 of approximately 4.25 inches. Curved top surface 36 has a radius 77 of approximately forty eight inches.

Still referring to FIG. 5, bottom edge 38 includes groove 40 positioned therein. Groove 40 defines a plank contacting surface 78 which typically is positioned at an angle 80 with respect to top curved surface 36. Angle 80 may be any angle between zero and 180 degrees, but typically is an acute angle on the order of approximately thirty degrees. Board contacting surface 78 or bottom edge 38 may comprise a flat surface, as shown in FIG. 2, or may comprise friction enhancing means 82, as shown in FIG. 5. In this embodiment, friction enhancing means 82 comprises an S-shaped curve on bottom edge 38 which grips a board and reduces the tendency of the wedge to move rearwardly in a direction 56 (FIG. 3) with respect to a floor board. In particular, the S-shaped curve defines a rounded leading edge of surface 38 and a pointed trailing edge of surface 38. Once the wedge has been forced in direction 46, the pointed trailing edge of surface 38 will tend to grip a board and reduce the possibility that the wedge will slide rearwardly in direction 56. Other friction enhancing means may comprise a rough texturized surface similar to that of sandpaper, a rubberized surface, or multiple projections that grasp the board. The S-shaped curve of bottom edge 38 is preferred due to the ease of machining such a shape on the wedge.

Figure 6:
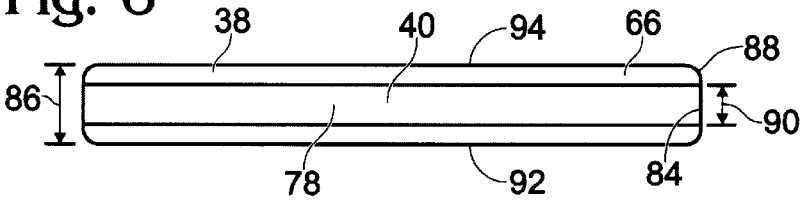
FIG. 6 is a front view of the wedge of FIG. 5.

FIG. 6 is a front view of the wedge of FIG. 4. Groove 40 of wedge 66 is shown, including bottom surface 38 which includes friction enhancing projection 84. Wedge 66 is shown having a thickness 86 of approximately 1.5 inches. The wedge is shown as having corners 88 which are rounded to a radius of approximately 0.25 inches, which facilitates movement of the wedge through cross bar 26. Groove 40 has a width 90 of approximately 0.63 inches. As will be understood by those skilled in the art, all dimensions recited herein are for a particular embodiment only, and the device of the present invention can be sized or scaled for any particular application.

Figure 7:
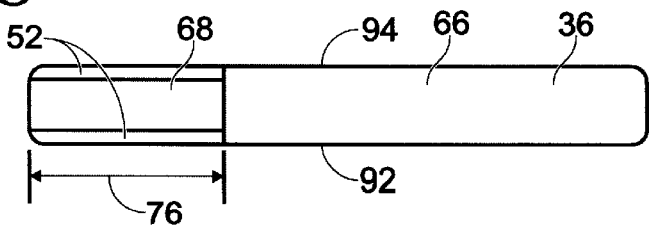
FIG. 7 is a rear view of the wedge of FIG. 5.

FIG. 7 is a rear view of the wedge of FIG. 4. Due to cutout area 68 of top curved surface 36, recessed grooves 52 can be seen on upper surface 92 and on lower surface 94 of the wedge.

Figure 8:
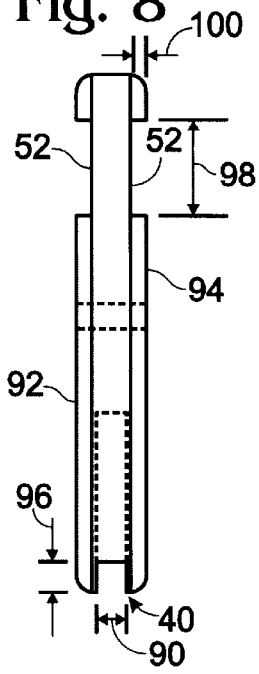
FIG. 8 is a side view of the wedge of FIG. 5.

FIG. 8 is a side view of the wedge of FIG. 4. Board contacting groove 40 is shown having a depth 96 of approximately 0.5 inches and width 90 of approximately 0.63 inches. Cross bar engaging recessed grooves 52 each have a width 98 of approximately 1.88 inches and each have a depth 100 of approximately 0.25 inches on both surfaces 92 and 94.

FIG. 9 is a side cross sectional view of the wedge having an adapter secured thereto. In particular, wedge 26 includes an adapter 102 secured within groove 40 by fasteners 104 so that the wedge may be used to abut snugly against the groove 106 of a floor board 108. Those skilled in the art will understand that the adapter may have any profile so as to abut snugly against any type of tongue, groove or flat edge surface of a board. Due to the use of adapter 102, and due to the ability of the device to be turned over (so that top surface 92 of the wedge is facing downwardly), the device of the present invention allows a carpenter to nail a center board in place and then floor outwardly in both directions without harming either the tongue or the groove edges of the floor boards. This time saving feature of the present invention, therefore, allows two carpenters to install a single floor while working independently in different directions from the secured central plank. Moreover, this allows the sub floor planks to the delivered to the job site adjacent to the centerline of the floor to be installed. If the carpenters work outwardly from the center of the floor, the floor planks need only be moved half the distance required of prior art flooring methods wherein the floor is installed from one edge of the foundation to the other. In other words, the device of the present invention reduces by fifty percent the material handling distances through which lumber must be carried at the job site.

Figure 10:
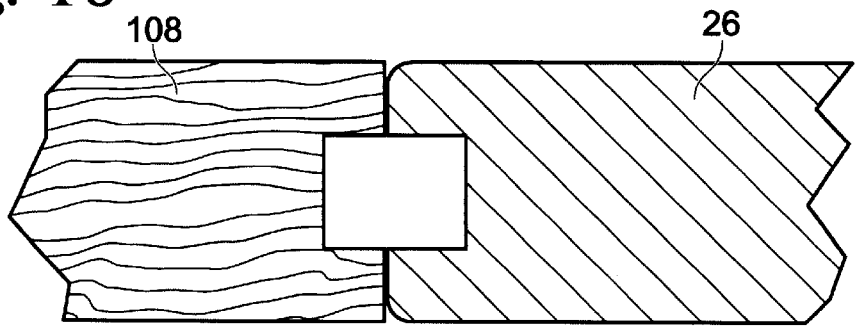
FIG. 10 is a side cross sectional view of the wedge positioned directly adjacent the groove edge of a floor plank.

FIG. 10 is a side cross sectional view of the wedge having no adapter secured thereto so that the groove edge of the wedge 26 contacts the groove edge of a board 108. Applicant has found this orientation provides sufficient contact between the wedge and the board to push the board without damaging the delicate groove edge of the board.

Figure 11:
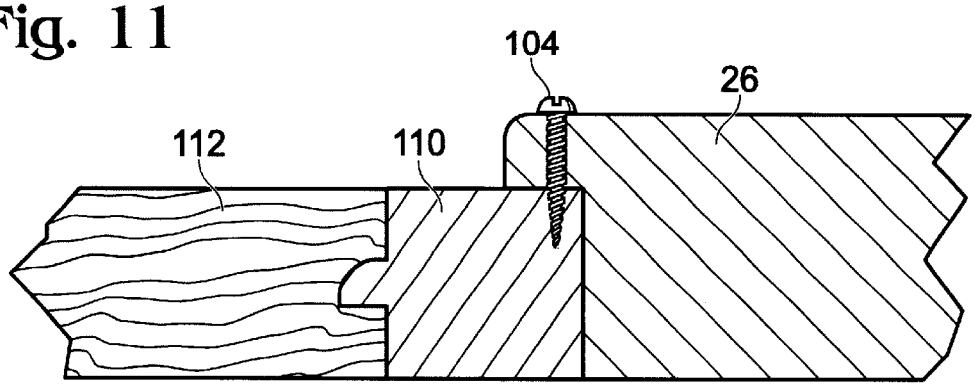
FIG. 11 is a side cross sectional view of the wedge having an adapter secured thereto.

FIG. 11 is a side cross sectional view of another wedge having an adapter secured thereto. Adapter 110 comprises a piece of wood having a tongue that matches the custom shaped groove of a board 112. The adapter typically comprises a piece of wood taken from the supply of floor planks being installed. Accordingly, by attaching a piece of the custom planking being used directly to the wedge, the device of the present invention can be used to push a plank having any shaped edge, without harming the delicate edge.

Accordingly, the method of use of the present has been disclosed. In another method, when the device is used to install plywood or other sheet like material, the following method is used. The sub floor sheets of wood, plywood, or the like are placed on the stringers. A carpenter nails and glues a first row of the sheets to the end most joist, i.e., at one end of the building (or at any location, such as at the very center of the floor to be installed). Adjacent rows of sheets are then placed next to the fastened row of sheets. Glue is placed between the loose sheets and the underlying stringers. Glue is also placed within the grooves of the loose sheets. The loose rows of sheets are then gently moved together so that the tongue edge of one row is aligned with the groove edge of the next row. Several rows are laid out in this manner so that several rows are loosely placed next to one another with glue in each of the grooves and glue between the stringers and the sheets. A set of duplex nails, i.e., nails having a double head so that the nail may be removed, is then driven into each of the sheets of each row of the loose plywood sheets, except for the row of sheets furthest from the secured row of sheets, to temporarily secure the sheets to the joists. The wedge device of the present invention is then used to wedge each of the sheets of the furthest row up against the adjacent row. During the installation process, the wedge device of the present invention preferably is centered on the long edge of each of the plywood sheets to pull the sheets in a direction normal to the tongue and groove edge of the sheet. Once these last two rows of sheets are in mating engagement along the tongue and groove connection, then the duplex nails in the second row of sheets are removed. The floor installation device is then used to push these two connected rows up against the third row of plywood sheets. The third row of sheets is held in place by its duplex nails. Once the three rows are pushed together, the duplex nails from the third row of sheets are removed. Due to the friction caused by the glue within the grooves, the sheets remain together. Moreover, because the present invention exerts an even force on the boards and holds the boards in the connected position, the plywood sheets do not tend to "bounce" as in the prior art installation method. This step of the method of the present invention is then repeated, pushing adjacent rows together until all the rows of sheets of loose plywood are pushed against the first, secured row. With the wedge holding the entire floor in place, the carpenter may then secure each of the plywood sheets in place permanently with standard fasteners, such as nails or screws. In this manner, an entire floor of sheeting material may be pulled together. The glue positioned between the sheets and underlying joists acts as a lubricant for the process. Because the glue acts as a lubricant in the process, a slow setting glue, such as Vulkem brand, preferably is used. Once the boards are secured in the place, the glue will harden to retain the boards in place. Accordingly, when no plumbing or air duct fixtures block the path of the floor boards (such as on the second or higher stories of a building wherein such fixtures typically are installed after the floor is installed) the method of the present invention allows a single carpenter to pull together an entire sub floor of sheets of flooring material, such as four foot by eight foot plywood sheets, which to Applicant's knowledge has never been done before.

The decking puller of the present invention has many advantages. The device may be used to pull up twenty feet or more or planks, instead of the mere forty inches or so of planks that may be pulled by prior art floor plank pulling devices. The puller of the present invention exerts a pushing force on the loose planks between two joists or stringers so that a single "pull" may be used to fasten the loose boards at two adjacent joists. In this manner, the device of the present invention need only be used between every other joist, so as to provide a fifty percent reduction in installation time as compared to the prior art pulling device. In one example, due to the combined benefits of pulling only between every other joist, and only at forty foot intervals, the device of the present invention only required 12 pulls for a floor installation, wherein the prior art pulling device would have required 78 pulls for the same sized floor. In other words, the device of the present invention provides an approximate eighty five percent reduction in the number of pulls required when compared to standard decking pullers. Moreover, the device can be operated by a single carpenter, instead of two carpenters as is required by the prior art device, thereby further reducing floor installation costs. As a further benefit, the decking puller of the present invention does not damage the delicate tongue or groove edge of the sub floor planks or the surface of previously secured sub floor planks, as does the device of the prior art.

As an additional benefit, the decking puller of the present invention may be used to pull tongue and groove plywood sheets together. To date, Applicant knows of no floor pulling device that may be used to pull plywood sheets together. In the past plywood sheets have each been individually pushed into place. The device of the present invention, however, allows an expanse of forty feet or more of plywood sheets to be pulled at one time. In particular, plywood sub floor sheets typically are required to be glued together along their mating tongue and groove edges, and are glued and nailed to the support stringers. The glue positioned between the stringers and the plywood sheets merely acts as a lubricant for sliding of the boards along the stringers as the boards are pulled by the decking puller. Accordingly, the device of the present invention can be used to pull plywood sub floor sheets, and "two-for-one" sub floor sheets (which act as both the sub floor and the top floor for the installation of carpet directly thereon).

While preferred embodiments of the present invention have been shown and described, it will be apparent to those skilled in the art that many changes and modifications may be made without departing from the invention in its broader aspects. The appended claims are intended to cover, therefore, all such changes and modifications as fall within the true spirit and scope of the invention.

I claim:

1. A board installation device comprising:

a base including an elongate body and first and second pins extending outwardly from said body and being adapted to be received on either side of a support member so as to retain said base in a secured position on a support member; and a wedge movably secured to said elongate body and including a board contacting surface and an elongate body contacting surface, wherein said board contacting surface and said elongate body contacting surface define an acute angle therebetween;

wherein said body contacting surface of said wedge includes a cutout region adapted to receive said first pin therein.

2. The device of claim 1 wherein said wedge includes a first surface having a first groove therein and a second surface including a second groove therein, and wherein said elongate body comprises a first edge received within said first groove and a second edge received within said second groove, so as to movably secure said wedge to said elongate body.

3. The device of claim 1 wherein said body contacting surface of the wedge defines an arcuate surface, and wherein said arcuate surface contacts said body in a region tangent to said arcuate surface.

4. The device of claim 1 wherein said board contacting surface of the wedge includes a board contacting groove therein.

5. The device of claim 1 wherein said wedge comprises a friction enhancing surface.

6. The device of claim 1 wherein said first and second pins extend perpendicularly outwardly from said elongate body and are spaced apart a distance in a range of one to ten inches.

7. The device of claim 2 wherein said elongate body comprises a first end region including said first pin secured therein and a second end region including a third pin secured therein, wherein said wedge is secured within said elongate body between said first pin and said third pin.

8. A method of installing a floor board on two supports, comprising the steps of:

providing a secured floor board secured to two supports;

providing a base including an elongate body having a length greater than a distance separating said two supports;

providing a wedge slidingly secured to said elongate body;

securing said base to at least one of said two supports and adjacent to said secured board such that said wedge is positioned between said elongate base and said secured board;

placing a loose board on said two supports and between said wedge and said secured board; and applying a force to said wedge so as to slidingly move said wedge along said elongate body such that said wedge abuts said loose board and moves said loose board into tight fitting contact against said secured board;

wherein said wedge includes a board contacting surface and a curved surface in contact with said elongate body, and wherein said wedge is adapted for pivotal movement with respect to said body such that said wedge contacts said loose board along said board contacting surface and such that said curved surface contacts said elongate body tangent to said curved surface.

9. The method of claim 8 wherein said base includes two pins secured to and extending outwardly from said elongate base, wherein said step of securing said base to at least one of said two supports comprises placing said elongate base on said at least one of said two supports such that said pins are each positioned on opposite sides of said at least one of said two supports, and the method further comprising the step of pivoting said elongate base with respect to said one of said two supports such that said two pins are each in contact with said at least one of said two supports thereby prohibiting further pivotal movement of said elongate base with respect to said at least one of said two supports.

10. The method of claim 8 wherein said step of placing a loose board on said two supports and between said wedge and said secured board further comprises placing a plurality of loose boards on said two supports and between said wedge and said secured board, and wherein said step of applying a force to said wedge so as to slidingly move said wedge along said elongate body moves each of said plurality of loose boards into tight fitting contact against one another and said secured board.

11. The method of claim 8 wherein said wedge includes a tongue receiving groove on said board contacting surface, and wherein said method further comprises securing an adapter to said board contacting surface wherein said adapter includes an outwardly extending projection adapted to be received within a groove of said loose board.

12. The method of claim 8 wherein said elongate body, said wedge, said loose board and said secured board are each positioned in a floor plane positioned above said two supports during installation of said floor board on said two supports.

13. A method of installing a floor board on two supports, comprising the steps of:

providing a secured floor board secured to two supports;

providing a base including an elongate body having a length greater than a distance separating said two supports;

providing a wedge slidingly secured to said elongate body;

securing said base to at least one of said two supports and adjacent to said secured board such that said wedge is positioned between said elongate base and said secured board;

placing a loose board on said two supports and between said wedge and said secured board; and applying a force to said wedge so as to slidingly move said wedge along said elongate body such that said wedge abuts said loose board and moves said loose board into tight fitting contact against said secured board;

wherein said elongate body is supported by said two supports during installation of said floor board on said two supports.

* * * * *